United States Patent [19]

Lordi

[11] Patent Number: 4,483,560

[45] Date of Patent: Nov. 20, 1984

[54] DISPOSABLE WASTE SCOOP AND SCRAPER

[75] Inventor: Peter F. Lordi, Highland, N.Y.

[73] Assignee: Ulster Manufacturing, Inc., Highland, N.Y.

[21] Appl. No.: 475,022

[22] Filed: Mar. 14, 1983

[51] Int. Cl.[3] ..... A01K 29/00; A47L 13/52

[52] U.S. Cl. ..... 294/1 B; 15/257.1; 294/55

[58] Field of Search ..... 294/1 B, 1 BA, 55; 15/104.8, 257.1, 257.2, 257.6, 257.7, 257.9

[56] References Cited

U.S. PATENT DOCUMENTS

| | | | |
|---|---|---|---|
| 2,651,925 | 9/1953 | Lawrence | 15/257.1 |
| 2,812,784 | 11/1957 | Palmer | 294/55 X |
| 3,449,786 | 6/1969 | Ross | 15/257.7 |
| 3,765,044 | 10/1973 | Hanahan et al. | 294/1 B X |
| 4,155,581 | 5/1979 | Kanaga | 294/1 B |
| 4,186,955 | 2/1980 | Campbell | 294/1 B |
| 4,272,116 | 6/1981 | Tufte | 294/1 B |

FOREIGN PATENT DOCUMENTS 2642524 3/1978 Fed. Rep. of Germany ..... 294/1 B

*Primary Examiner*—Johnny D. Cherry
*Attorney, Agent, or Firm*—Sixbey, Friedman & Leedom

[57] ABSTRACT

A disposable scoop and scraper device for collecting waste materials from a surface comprises a scoop, including shovel and handle portions, and a generally elongate, planar scraper member detachably mounted via a tear line on the shovel portion. The scraper member includes longitudinally extending ribs impressed into the upper surface and projecting from the lower surface thereof for dividing the scraper member into a first relatively rigid zone adapted to be grasped when the scraper member is detached from the shovel portion and a second relatively resilient and deformable zone adapted to be placed into contact with the surface and to be deformed into close engagement therewith by force applied to the first zone.

9 Claims, 5 Drawing Figures

DISPOSABLE WASTE SCOOP AND SCRAPER

DESCRIPTION

1. Technical Field

The present invention relates to disposable scoops and, more particularly, to such scoops having disposable scrapers detachably secured thereto.

2. Background Art

Scoops and scoop-container combinations of numerous types are well known to the prior art for handling various types of particulate material, such as ice cubes, flour, sugar and the like, and for the sanitary collection and disposal of waste matter, such as animal pet fecal waste matter. Typically, the scoops of the prior art have an open cavity bounded by various structural shapes and comprise, essentially, a bottom with upturned sides and a back and a handle on the back portion. U.S. Pat. No. 3,804,450 discloses just such a scoop as a multipurpose yard and gardening tool. U.S. Pat. No. 3,840,261 discloses a scoop having a conventional material carrying compartment defined by a bottom and upstanding side and rear walls and including a handle compartment for housing a handle extending rearwardly from the rear wall to prevent contact of a person's hand with the material when holding the handle. U.S. Pat. No. 4,138,153 discloses a collapsible fecal waste container comprising an open frame defining an opening through which fecal matter may be placed in the container, a pouch extending rearwardly from and affixed to the frame at one end and closed at the other for containing the waste and a serrated shovel portion projecting forwardly from the frame bottom. Extending rearwardly from the shovel portion into the pouch and defined from the shovel portion by a tear or break line is a disposable barrier member which is detachable from the shovel portion and may be used for placing fecal waste into the pouch.

The most difficult problem encountered in collecting waste in a scoop type device is gathering all of the waste into the material carrying compartment or volume of the scoop and not leaving any on the surface. This is particularly important where the waste is biological and may contain bacterial, viral or other contamination. Typically, waste is collected from a surface by holding the scoop by the handle and thrusting the leading edge of its material carrying compartment into the waste, causing the waste to deposit in the compartment as the scoop moves through. Alternatively, some type of scraper is either improvised or provided to push the waste into the material carrying compartment. However, neither of these methods has proven particularly effective in gathering all of the waste on a surface. Particularly where the waste is liquid or substantially liquid no prior scoop or scoop and auxiliary scraper has been able to effectively remove all of the waste from the surface and collect it into the scoop. Accordingly, it is the purpose of the present invention to provide a waste collecting disposable scoop and unique detachable scraper device which is simple and inexpensive to manufacture and assemble, durable and efficient in use and able to substantially completely remove and collect either solid or liquid waste from a surface.

DISCLOSURE OF THE INVENTION

In one aspect of the present invention this is accomplished by providing a disposable scoop and scraper device for collecting waste materials from a surface which comprises a scoop, including a generally open front shovel portion and a handle portion extending therefrom, and a generally elongate, planar scraper member detachably mounted via a tear line to the shovel portion, the scraper member including longitudinally extending rib means for dividing the scraper member into a first relatively rigid zone adapted to be grasped when the scraper member is detached from the shovel portion and a second relatively resilient and deformable zone adapted to be placed into contact and deformed into close engagement with the surface by force applied to the first zone.

In another aspect of the present invention the scraper member includes at least two longitudinally extending elongated rib members impressed into the upper face and projecting below the lower face thereof, the ribs extending between and spaced from the end edges of the scraper member for defining opposite end portions between the end edges and the adjacent rib ends, one of the end portions having a greater longitudinal length than the other end portion, the first relatively rigid zone including the longitudinally shorter end portion and the second relatively resilient and deformable zone including the longitudinally longer end portion.

BRIEF DESCRIPTION OF THE DRAWINGS

The invention will be better understood from the following description taken in conjunction with the accompanying drawings, in which.

BEST MODE FOR CARRYING OUT THE INVENTION

Figure 1:
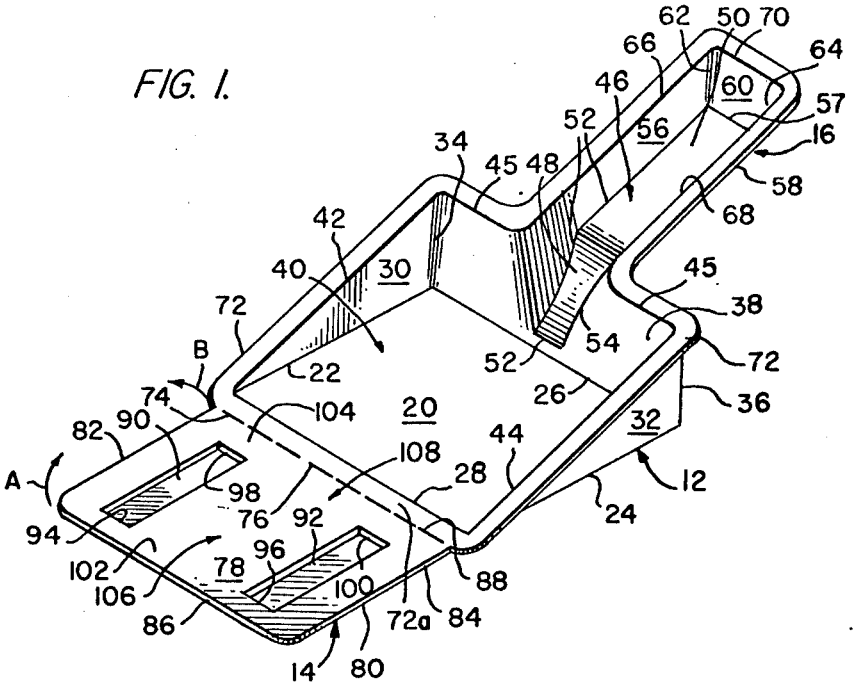
FIG. 1 is a perspective view of the disposable waste scoop and scraper device of the present invention.
Figure 2:
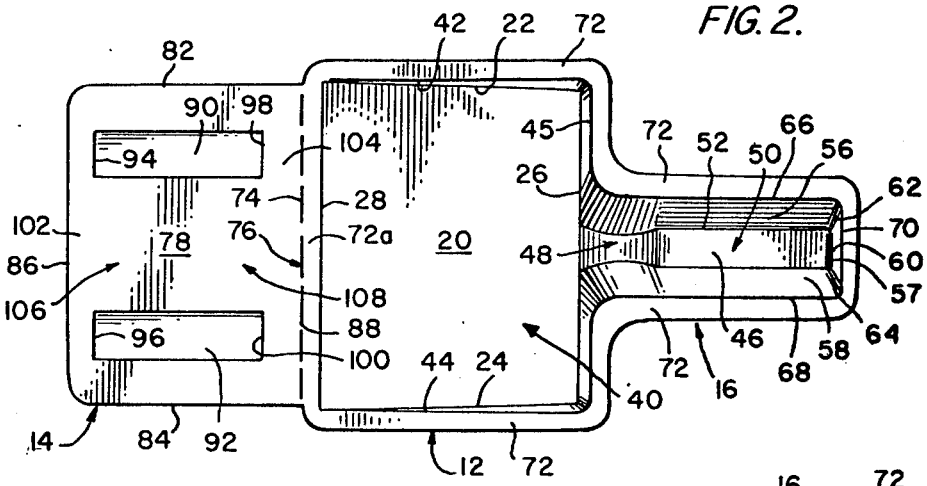
FIG. 2 is a plan view of the disposable waste scoop and scraper device of FIG. 1.
Figure 3:
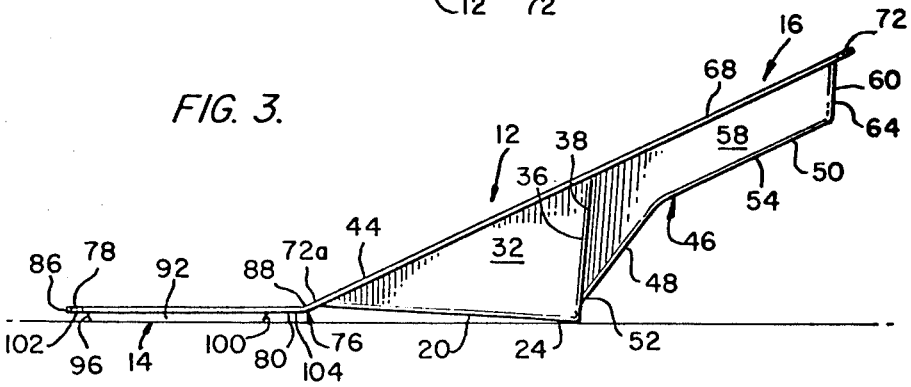
FIG. 3 is a side elevational view of the disposable waste scoop and scraper device of FIG. 1.

Referring to FIGS. 1–3, the disposable waste scoop and scraper device of the present invention is shown in detail. The scoop and scraper device may be economically fabricated in one piece of various materials, preferably of semi-rigid plastic which allows a certain amount of flexibility and resilience, by techniques such as casting, stamping, molding, and the like. The scoop and scraper device of the present invention comprises a shovel portion 12, a detachable scraper portion 14 extending forwardly from the forward edge of the shovel portion and defined therefrom by a tear line, and an elongated handle portion 16 extending rearwardly from the shovel portion.

Shovel portion 12 is formed with an elongate, substantially planar bottom 20, a pair of elongate, upstanding longitudinal side walls 30,32 which project upwardly and generally perpendicularly from each longitudinal side edge 22, 24 of the planar bottom 20 and a rear wall 38 which projects upwardly and generally perpendicularly from the rear edge 26 of the planar bottom 20 and joins the rear edges 34,36 of the side walls 30,32. Side walls 30,32 incline upwardly and rearwardly from the forward edge 28. The resulting shovel portion 12 defines a material carrying compartment 40 which is open at its front and is bounded by generally planar and rectangular bottom 20 and rear wall 38 and generally triangular side walls 30,32.

An elongated handle portion 16 inclines upwardly and rearwardly from rear wall 38 to provide a convenient gripping means for shovel portion 12. Desirably, handle portion 16 inclines rearwardly at substantially the same angle to the horizontal as the upper edges 42,44 of side walls 30,32 form with bottom 20 to facilitate applying forwardly and downwardly directed pressure to handle portion 16 to force bottom 20, and particularly the leading edge portion thereof, into close engagement with the surface on which the waste is located. In the embodiment shown in FIGS. 1–3, handle portion 16 is generally channel shaped, opening upwardly and including an elongate floor 46 inclining upwardly and rearwardly in two integral, planar sections 48, 50 from its intersection 52 with rear wall 38 just above the rear edge 26 of bottom 20. First floor section 48 comprises a rearwardly recessed central portion of rear wall 38 inclining upwardly and rearwardly from intersection 52 at an acute angle to the horizontal which is substantially greater than the angle formed by the upper edges 42,44 of side walls 30,32 with bottom 20. Second floor section 50 inclines upwardly and rearwardly from the first floor section 48 at an acute angle to the horizontal which is substantially the same as the angle formed between upper edges 42,44 of side walls 30,32 and bottom 20. Outwardly divergent side walls 56,58 and rear wall 60 extend upwardly from the longitudinal side edges 52,54 and rear edge 57 of handle floor 46 with handle rear wall 60 joining the rear edges 62,64 of handle side walls 56,58 to form an upwardly opening elongate handle portion 16 which is enclosed on its sides and rear and which opens at its forward end, through rear wall 38, into material carrying compartment 40.

A continuous, generally planar peripheral flange 72 extends outwardly from the forward edge 28 of bottom 20, from the upper edges 42,44,45 of side walls 30,32 and rear wall 38 of shovel portion 12 and from the upper edges 66,68,70 of side walls 56,58 and rear wall 60 of handle portion 16 for conferring rigidity upon the scoop and scraper device. Forwardly extending flange portion 72*a*, which is inclined at about the same angle to the horizontal as the upper edges 42,44 of side walls 30,32 form with bottom 20, defines a semi-rigid ramp which facilitates sweeping or scraping waste into the material carrying compartment 40 of shovel portion 16. Extending forwardly from the leading edge 74 of flange portion 72*a* and defined therefrom by a tear line or line of weakness 76 is detachable scraper portion 14 which is a generally planar, generally rectangular member having upper and lower faces 78,80, a pair of generally parallel longitudinal sides 82,84 and a pair of generally parallel front and rear sides 86,88. Tear line 76 is defined by the joinder of rear side 88 and leading edge 74 and is substantially coextensive therewith and with the width of bottom wall 20, i.e., the front shovel portion opening.

Detachable scraper portion 14 includes at least a pair of generally parallel ribs 90,92 impressed into upper face 78 and projecting below lower face 80 which extend longitudinally between and spaced from front and rear sides 86,88. This rib configuration confers a degree of rigidity on scraper portion 14 which allows it to be more readily bent or flexed in a manner which forms a generally concave configuration having upper surface 78 as the inner surface of the concavity, i.e., scraper portion 14 is more readily bent in the direction shown by arrows A, B in FIG. 1. Each of ribs 90,92 is forwardly offset, i.e., its forward end 94,96 is closer to front side 86 than its rear end 98,100 is to rear side 88, defining a scraper front end portion 102 which is shorter than scraper rear end portion 104. Ribs 90,92 divide scraper portion 14 into two functional zones having differing flexibilities, a front relatively rigid zone 106, including front end portion 102, adapted for grasping with the fingers when scraper portion 14 is detached from shovel portion 12 and to which force and pressure can be applied without substantial deformation or bending thereof and a rear relatively flexible, deformable and resilient zone 108, including rear end portion 104, which can be made to closely engage a surface to which rear side 88, serving as the scraper working edge, is applied. When front zone 106 is grasped with the fingers and rear side scraper working edge 88 is in contact with the surface on which the waste to be collected is located, a generally downwardly directed bending pressure with the fingers along the upper surface 78 of front zone 106 causes scraper portion 14 to resiliently deform forcing rear zone 108 to closely engage the surface in order that the waste may be forced into the material carrying compartment 40 of shovel portion 12. When the waste is in the form of a liquid spill, a squeegee effect can be produced in this manner to force the liquid into shovel portion 12. If desired, scraper working edge 88 may be beveled or otherwise reduced in thickness along its width to facilitate its use as an effective scraper edge.

Industrial Applicability

The disposable waste scoop and scraper device of the present invention is broadly applicable to and useful for the collection of all forms and types of waste. The unique configuration of scraper portion 14 allows it to effectively force either solid or liquid waste into the efficiently configured shovel portion 14 for collection and disposal.

Figure 4:
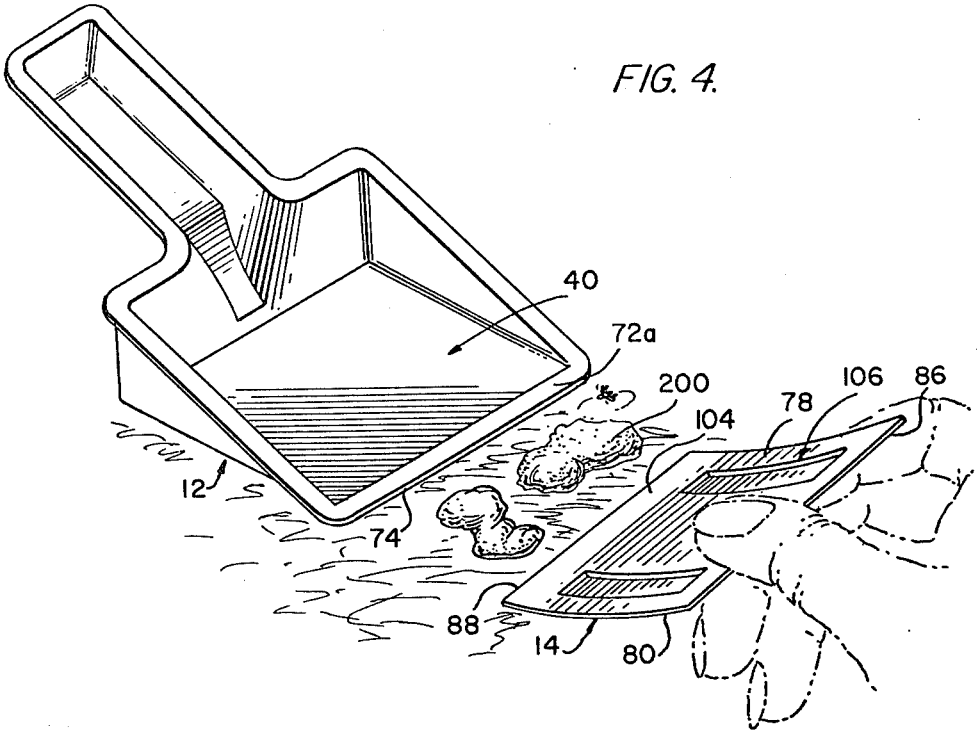
FIG. 4 is a perspective view illustrating one manner of collecting waste using the scoop and scraper device of FIG. 1.
Figure 5:
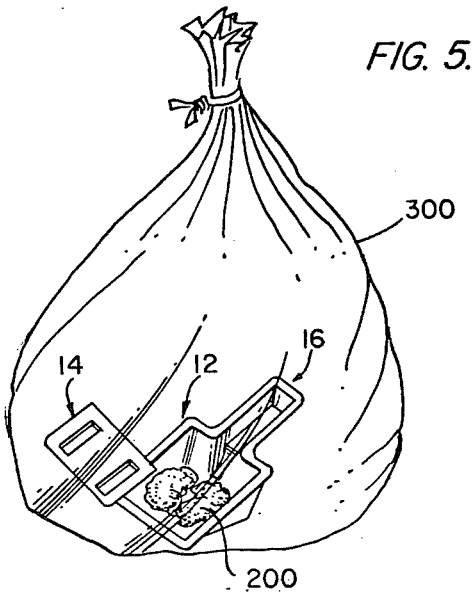
FIG. 5 is a perspective view of one method of disposing of the waste scoop and scraper device of FIG. 1 after it has been used.

Specifically, with particular reference to FIGS. 4 and 5, in use the scraper portion 14 is detached from the leading edge 74 of forwardly extending flange portion 72*a* along tear line 76. Handle portion 16 is grasped in one hand and the opening of shovel portion 12 is directed toward the waste 200 while the scraper portion 14 is grasped in the other hand and used to push, squeegee or otherwise force the waste into the material carrying compartment 40 of shovel portion 12. With the scraper working edge 88 engaging the surface on which the waste is located, the thumb of the scraper portion gripping hand applies a downwardly directed pressure to the upper face 78 of front zone 106 while, at the same time, the lower face 80 of front zone 106 is supported by the side of the index finger just above the knuckle. This causes upper surface 78 of scraper portion 14 to deform downwardly between the front and rear sides 86,88 thereof and forces the lower face 78 of scraper rear end portion 104 to closely engage the surface on which the waste is located. Scraper portion 14 may then be used to push, squeegee or otherwise force the waste into shovel portion 12, as by pushing scraper portion 14 toward shovel portion 12 with the scraper working edge 88 and the lower surface 78 of rear end portion 104 slidingly and closely engaging the surface to cause the waste to move up ramp-like forwardly extending flange portion 72*a* into material carrying compartment 40. Alternatively, scraper portion 14 may act as a barrier for preventing movement of the waste away from shovel portion 12 as the shovel portion is thrust toward the waste to force it over flange portion 72*a* into compartment 40. When all of the waste 200 has been collected into shovel portion 12, the shovel portion 12, waste 200 and scraper portion 14 may be disposed of in any convenient manner, such as by placing into a disposable plastic bag 300 which may be closed or tied in any suitable manner.

I claim:

1. A combination disposable scoop and scraper device for collecting waste materials from a surface comprising:

a scoop including a shovel portion and a handle portion extending therefrom, said shovel portion having a generally planar bottom, a pair of opposite logitudinal sides extending upwardly from said bottom and a rear wall extending upwardly from said bottom and joining said sides, said bottom, sides and rear wall defining a generally open front cavity for receiving waste materials; and a generally planar scraper member detachably mounted via a tear line on said shovel portion, said scraper member comprising first and second opposite end edges and including rib means for dividing said scraper member into a first relatively rigid zone and a second relatively resilient and deformable zone, said rib means including at least two elongated ribs extending between and spaced from said end edges, a first end portion extending between said first end edge and the ends of said ribs adjacent thereto and a second end portion extending between said second end edge and the ends of said ribs adjacent thereto, said second end portion having a greater length between its end edge and said rib ends than said first end portion, said first zone, including said first end portion, adapted to be grasped when said scraper member is detached from said shovel portion and said second zone, including said second end portion, adapted to be placed into contact with said surface and to be deformed into close engagement therewith by force applied to said first zone, whereby waste on said surface may be forced into said cavity by said scraper member.

2. A device, as claimed in claim 1, wherein said generally planar scraper member includes upper and lower faces and said rib means is impressed into said upper face.

3. A device, as claimed in claim 2, wherein said rib means project below said lower face.

4. A device, as claimed in claim 1, wherein said ribs are substantially parallel.

5. A device, as claimed in claim 4, wherein said ribs are substantially the same length.

6. A device, as claimed in claim 5, wherein said tear line includes said second end edge and said ribs extend substantially perpendicular thereto.

7. A device, as claimed in claim 1, wherein said scraper member is mounted on said shovel portion bottom.

8. A device, as claimed in claim 7, wherein said scraper member extends forwardly from the forward edge of said bottom and is defined therefrom by said tear line.

9. A device, as claimed in claim 8, wherein said tear line includes said second end edge.

* * * * *